US005345643A

United States Patent [19]

Tomm

[11] Patent Number: 5,345,643

[45] Date of Patent: Sep. 13, 1994

[54] WET MOP HOLDER

[76] Inventor: Erwin Tomm, 3320 W. 130th St., Cleveland, Ohio 44111

[21] Appl. No.: 20,277

[22] Filed: Feb. 18, 1993

Related U.S. Application Data

[63] Continuation of Ser. No. 823,759, Jan. 22, 1992, abandoned.

[51] Int. Cl.[5] ..... A47L 13/255

[52] U.S. Cl. ..... 15/147.1; 15/153; 15/229.2

[58] Field of Search ..... 15/147.1, 147.2, 150, 15/151, 153, 228, 229.2

[56] References Cited

U.S. PATENT DOCUMENTS

| | | | |
|---|---|---|---|
| D. 281,361 | 11/1985 | Jaros . | |
| 3,682 | 10/1869 | Taylor | 15/153 |
| 10,237 | 11/1853 | Randlett . | |
| 65,662 | 6/1867 | Garretson | 15/153 |
| 112,556 | 3/1871 | Davis | 15/153 |
| 132,580 | 10/1872 | Hood | 15/153 |
| 842,622 | 1/1907 | Burnham . | |
| 939,883 | 11/1909 | Wichmann et al. . | |
| 965,546 | 7/1910 | Wallace et al. . | |
| 1,147,174 | 7/1915 | Johnson | 15/150 |
| 1,498,615 | 6/1924 | Eiffe | 15/150 |
| 1,886,338 | 11/1932 | Hirth . | |
| 2,203,189 | 6/1940 | Casinello | 15/147 R |
| 2,542,751 | 2/1951 | Capstack | 15/147 R |
| 2,650,382 | 9/1953 | Ballinger . | |
| 2,807,819 | 10/1957 | Healy | 15/153 |
| 3,457,581 | 7/1969 | Oas . | |
| 3,605,161 | 9/1971 | Moss et al. . | |
| 4,006,509 | 2/1977 | Chase . | |
| 4,135,272 | 1/1979 | Stephenson . | |
| 4,287,632 | 9/1981 | Hammond . | |
| 4,377,879 | 3/1983 | Christo . | |
| 4,422,203 | 12/1983 | Zenker . | |
| 4,464,807 | 8/1984 | Weiss . | |
| 4,483,035 | 11/1984 | Moss et al. . | |
| 4,524,479 | 6/1985 | Chase . | |
| 4,530,130 | 7/1985 | Moss . | |
| 4,541,139 | 9/1985 | Jones | 15/146 |
| 4,765,014 | 8/1988 | Moss | 15/229.3 |
| 4,995,134 | 2/1991 | Monahan | 15/147 R |

FOREIGN PATENT DOCUMENTS

| | | | |
|---|---|---|---|
| 863691 | 3/1961 | United Kingdom | 15/147 R |
| 2098122 | 11/1982 | United Kingdom | 15/147 R |

*Primary Examiner*—Timothy F. Simone
*Assistant Examiner*—Randall E. Chin
*Attorney, Agent, or Firm*—Watts Hoffmann Fisher & Heinke

[57] ABSTRACT

The wet mop holder of the invention comprises a mop holding head :having a substantially round forward end with a groove disposed therein. The mop holder includes a moveable tightening member disposed in a spaced relation to the mop holding head. The tightening member rides on a shaft connected to the mop holding head.

14 Claims, 5 Drawing Sheets

WET MOP HOLDER

This application is a continuation of application Ser. No. 07/823,759, filed Jan. 22, 1992, abandoned.

FIELD OF THE INVENTION

This invention relates to cleaning and janitorial devices, and more particularly to an improved wet mop holder.

BACKGROUND OF THE INVENTION

In the field of cleaning and .janitorial devices, mop holders, such as a yarn or wet mop holders, come in a wide variety of designs and mate:rials. Many mop holders have drawbacks. Over time, some metal wet mop holders have a tendency to corrode since they are frequently exposed to water and cleaning solutions. As a result, these mop holders become dirty, difficult to manipulate and must eventually be thrown away. Moreover, many metal wet mop holders have sharp edges and protrusions that can snag or scratch furniture or injure the person using the device. A further disadvantage of some metal mop holders is that they are noisy due to the clanking together or grinding of the metal parts.

Some wet mop holders include a straight forward edge with a bar or other means for securing the mop along the edge. Many of these mop holders permit the mop to bunch along the edge and often fail to utilize all of the mop. Further, straight edged or bulky mop holders are difficult to use in tight or crowded places. Still other holders are heavy and difficult to manipulate. The corners of bulky plastic frames tend to wear out and break and straight edged mop frames are awkward since they are often wider than the mop that they hold.

To overcome the problems associated with the prior art, it is an object of the invention to provide an improved wet-mop holder that is quiet, economical, efficient, compact and easily manipulated. These and other objects of the instant invention will become apparent to those skilled in the art in view of the following disclosure.

SUMMARY OF THE INVENTION

To achieve the advantages of the invention there is provided a mop holder comprising a shaft connected at an end to a mop holding head, the head having a substantially rounded forward end with a groove disposed therein. The rounded forward end corresponds substantially to a segment of a circle having a radius of no more than about 2.5 inches such that said mop holding head is no more than about 5 inches wide in the plane of the head. A tightening member is movably disposed on the shaft in a spaced relation to the head and includes means for adjusting its position relative to the head, along the shaft. To secure a mop, such as a yarn or string mop, a flexible strap that is connectable to the tightening member is provided. In use, a mop is placed along the forward edge of the head, and the strap is connected to the tightening member so that a portion of the mop is disposed between the strap and the forward edge. The mop is secured tightly in place by causing the adjusting means to move the tightening member along the shaft, away from the head.

In a preferred embodiment of the claimed invention, the means for adjusting the tightening member comprises a nut disposed in a void in the tightening member.

The nut engages exterior threads that are disposed on the shaft so that the tightening member can be adjusted toward and away from the head along the shaft by turning the nut.

As described herein a preferred mop holding assembly according to the invention comprises a mop holding head which has a substantially rounded forward end having a groove disposed therein and a rear end having a socket for receiving a threaded shaft. A front end portion of the threaded shaft is receivably engageable in the socket and a rear end portion of the shaft is adapted to receive a handle. The tightening member fits slidably on the shaft and has a void for receiving a threaded nut. The nut operates to move the tightening member in either direction along the exterior threading of the shaft. Preferably, the flexible strap has one end secured to a side of the tightening member and the other end free but connectable to the opposite side of the tightening member.

In order to prevent the wet mop from shifting and bunching in the groove when in use, a further embodiment comprises forming raised ribs perpendicularly in the groove. The ribs help prevent lateral movement and shifting of the mop when in use.

DETAILED DESCRIPTION OF THE INVENTION

Figure 4:
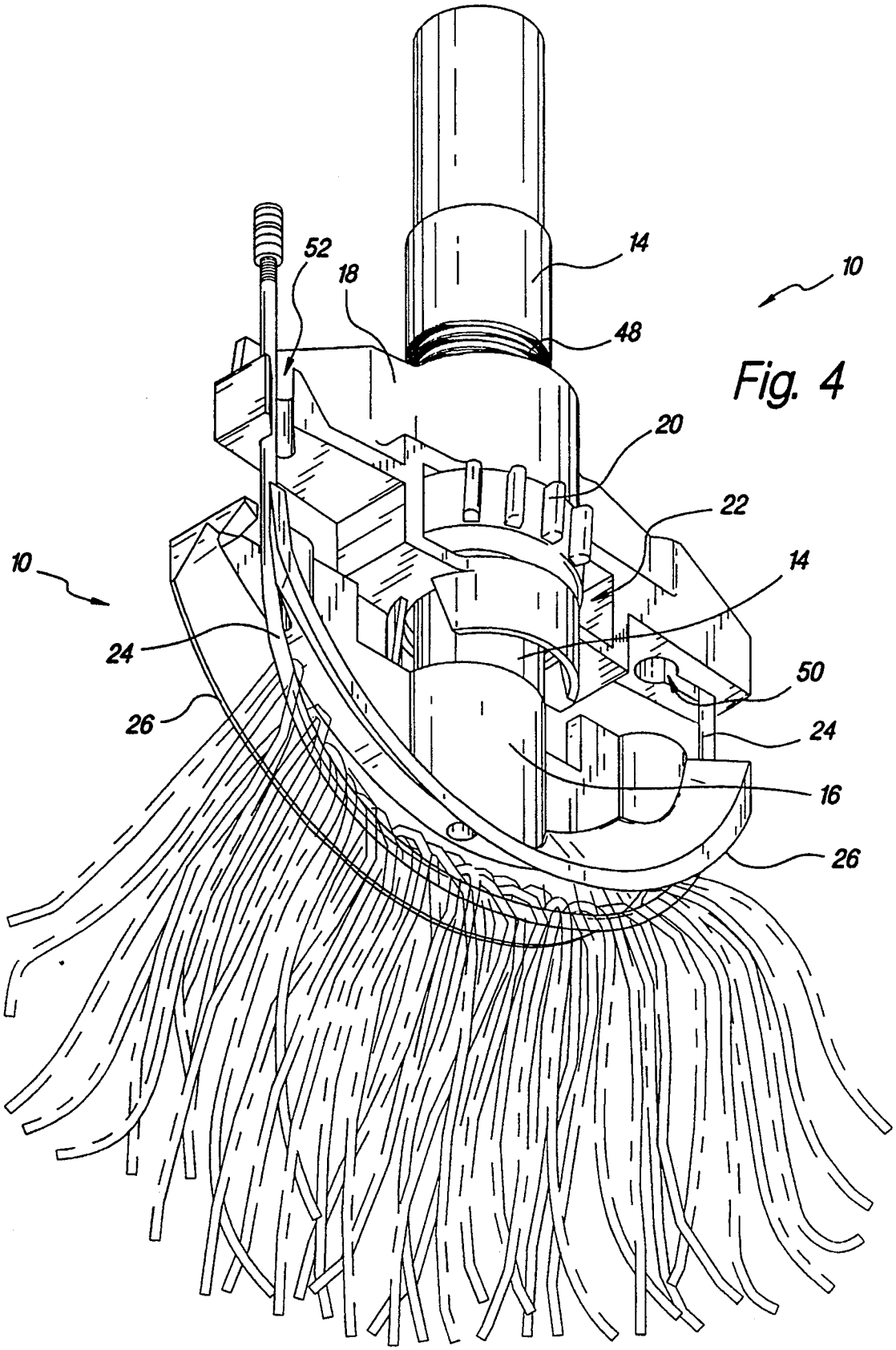
FIG. 4, is a perspective view of the mop holding assembly showing the relative placement of a mop.

The preferred embodiment of the invention is shown in the drawings. In FIG. 4, the mop holder assembly is seen in a relatively untightened mode. The mop holder assembly 10 comprises the general elements of a mop holding head 12 having a shaft 14 connected to a socket 16 at the rear of the head; an adjustable tightening member 18 movably disposed on the shaft; a nut 20 disposed in a void 22 in the tightening member which is threadably engaged on the shaft; and a flexible strip connected to the tightening member that runs from one side of the tightening member, along the forward edge 26 of the head to the other side of the tightening member.

Figure 1:
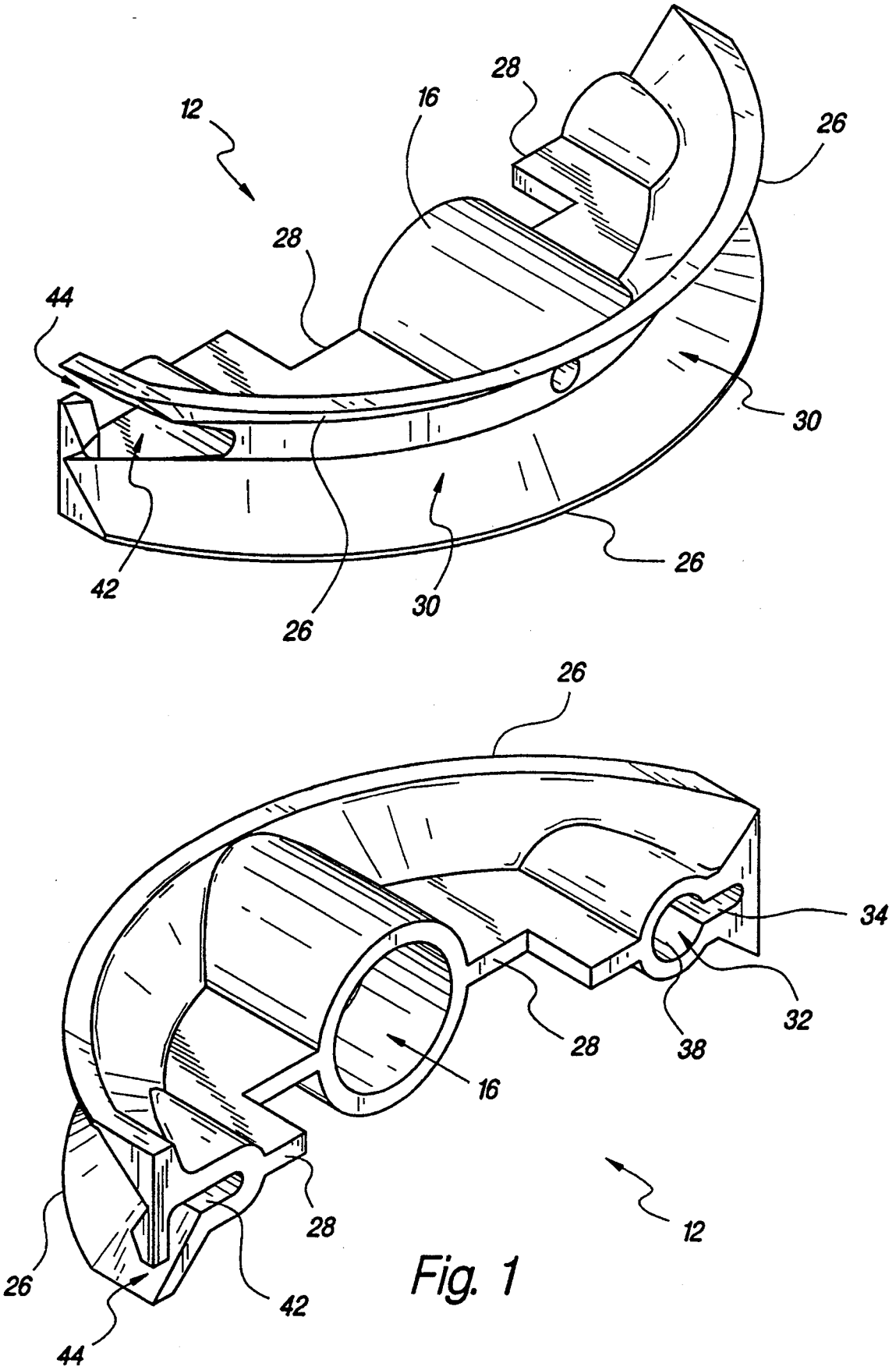
FIG. 1, is a perspective view of the forward and rearward ends of the mop holding head of the invention.
Figure 2:
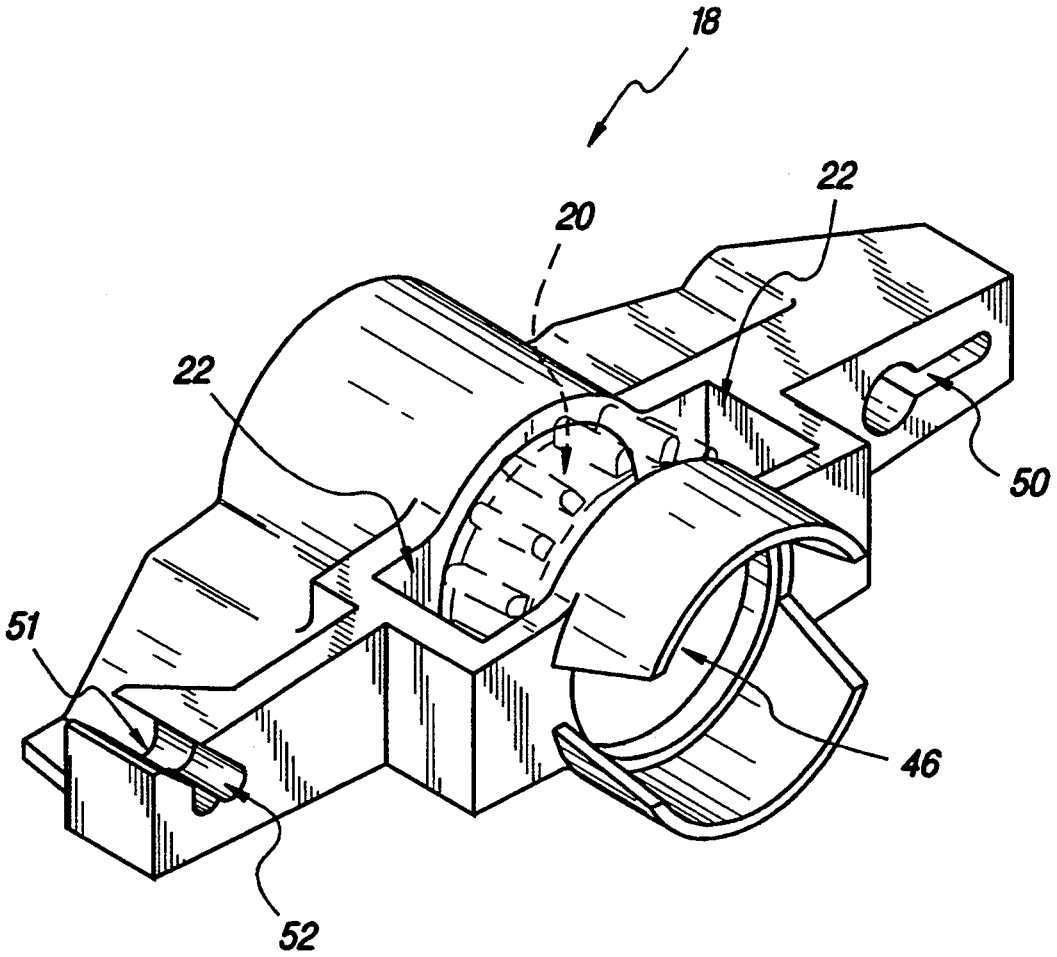
FIG. 2, is a perspective view of the tightening member of the :invention.

Importantly, the forward end 26 of the mop holding head is substantially rounded, i.e. curved, such that the forward end of the mop holding head is a crescent shape. As can be seen in FIG. 1, the rounded forward end, or arcuate portion, 26 of the mop holding head 12 is convex with respect to the rearward end surface 28, and terminates proximal to the end surface 28 at two points at opposite ends of the rounded or arcuate portion 26 so that the length of any straight perimetral side surfaces between the rearward end 28 and the respective end points of the rounded forward end is minimized and substantially less than the width of the forward end. As shown, the rearward end 28 of the mop holding head has a socket 16 for receiving a shaft 14. The shaft may be secured into said socket by known fasteners such as screws, cross-pins, rivets and the like. Preferably, the shaft is secured into the socket by a press-fit. The forward edge of the mop holding head has a groove 30 disposed therein. The groove, which is preferably substantially V-shaped to allow a mop to spread evenly and freely out from the head, travels the length of the substantially round forward end. The groove terminates at a slot 32 at one side of the forward end 26. The slot has a narrow portion 34 for receiving a strap 24, and an enlarged portion 38 for receiving an enlarged head portion of the strap. The slot 32 is a void in the rearward end 28 of the mop holding head 12. The strap is received into the slot by feeding its enlarged portion 52 through the enlarged portion 38 of the slot. When received by the slot, the strap is enclosed into the end of the groove.

Figure 3:
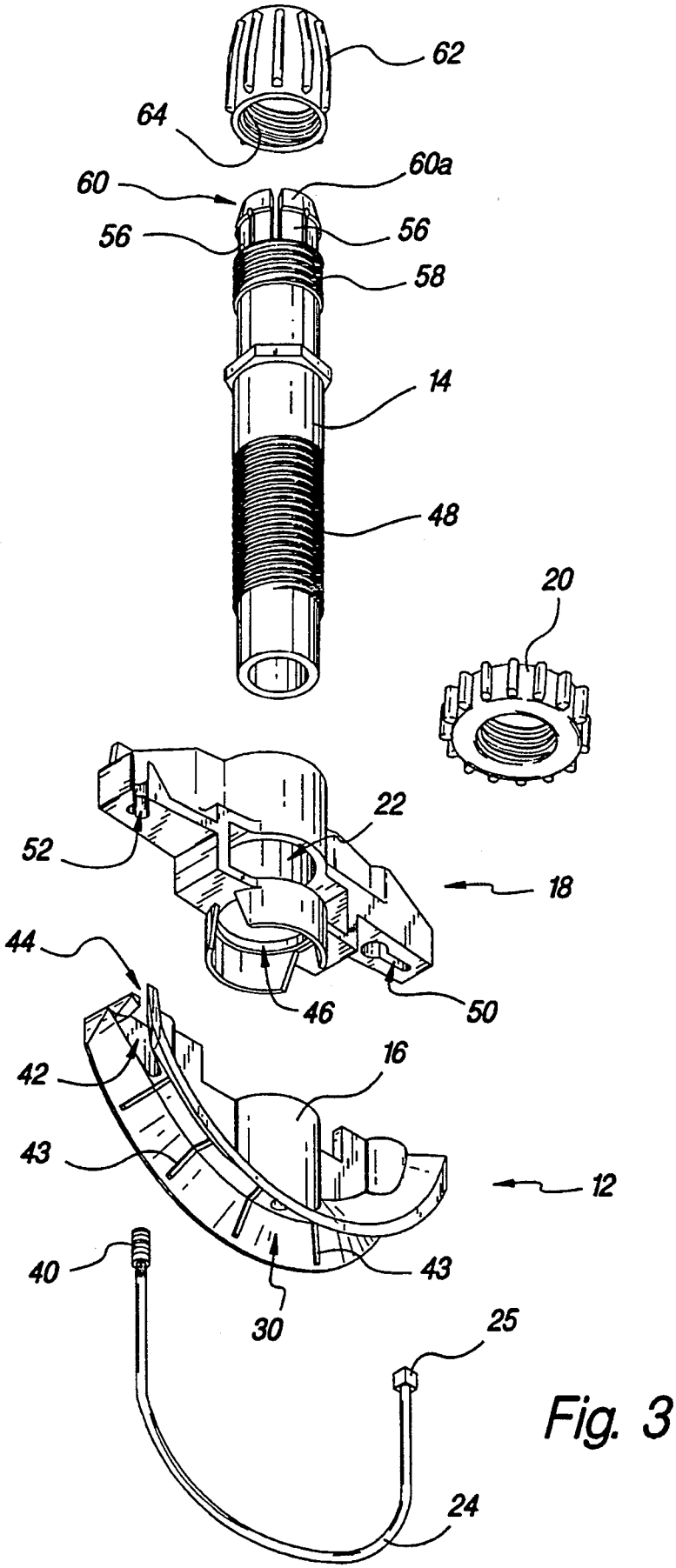
FIG. 3, is an exploded view of the mop holding assembly of the invention.

The groove 30 terminates at the opposite side of the forward edge at a second slot 42 having a notch 44 therein for receiving a portion of the strap into the groove. The second slot 42 freely receives the strap but does not enclose it into this end the groove. Thus, the second slot permits a portion of the strap to move freely in and out of the groove via the notch. As seen in FIG. 3, the groove 30 can have raised ribs 43 disposed perpendicularly therein. The ribs assist in the securing of the mop by reducing any possible lateral shifting or bunching along the forward end 26.

Advantageously, the forward end 26 of the mop holding head 12, with the groove 30 disposed therein is substantially rounded. Since the mop head is substantially rounded along its forward end, it is relatively narrow from side to side. In other words, the head can hold any width of string mop in a narrower space than is possible if the mop were simply disposed along a straight edge because the width of the mop is displaced in a radius. Thus, the mop head of the invention makes it easy to mop into corners, tight spots and other congested areas. Thus, it is preferable that the mop holding head is no more than about 5 inches wide. Further, since a mop that is secured to the rounded edge is thereby spread out radially, the effective use of the entire string mop is possible i.e., the mop is spread out evenly on the floor and the whole width of the mop is utilized without the problem of bunching. By securing the mop along the round forward edge less energy is required to move the mop laterally back and forth than would be required if the mop were secured along a flat, straight edge. This is because less friction, and therefore resistance, exists when moving the mop laterally from side to side and there is no bunching as seen with forward edges that are straight. Thus, the mop holder of the invention causes less fatigue.

The adjustable tightening member 18 has a central hole 46 for receiving the shaft 14. The shaft itself is tubular and has exterior threads 48 disposed on its outer surface. The central hole of the tightening member receives the shaft so that the tightening member can move longitudinally thereon in a spaced relationship with the mop holding head 10. The tightening member has a void 22 disposed therein normal to and intersecting the central hole. The void receives a threaded nut 20 that engages the threads disposed on the exterior surface of the shaft. The tightening member rides on the nut 20 so as to be movably disposed on the shaft. By rotating the nut the tightening member is adjusted longitudinally along the shaft with the nut.

On one side of the tightening member 18, shown as the side corresponding to the side of the head with the slot 32, there is a slot 50 wherein the end of the flexible strip 24 is fixedly attached. The strap extends from the slot 50 through the slot 32 on the head 12. On the opposite side of the tightening member there is a notch 52 for releasably receiving the enlarged portion 40 of the strap. When the strap extends from slot 50, through slot 32, along the groove 30, into notch 44 and then toward the notch 52, a portion thereof is received into the slot. The enlarged portion can then be disposed in the notch 52 against support flange 51 to secure the free end of the strap to the tightening member.

Advantageously, a dirty or old mop may be quickly and easily replaced with a new mop by turning the nut to move the tightening member toward the head thereby loosening the strap. By releasing the free end of the strap from the notches 52 and 44, the old mop is freed from the mop holding head. To replace it, a new mop is simply placed along the forward edge of the mop holding head and the strap pulled across it, slipped into the groove and the enlarged portion inserted into the slot. The mop is then quickly and easily secured by tightening the nut so as to move the tightening member away from the mop holding head. Advantageously, the mop holder is economical since mops do not require a head band for use with this invention. Thus, in addition to the advantages inherent in the invention itself, the invention also enables a reduction in the costs of the mops themselves since head bands may no longer be necessary, rather only a minimum stitching to hold the mop strings together.

Figure 5:
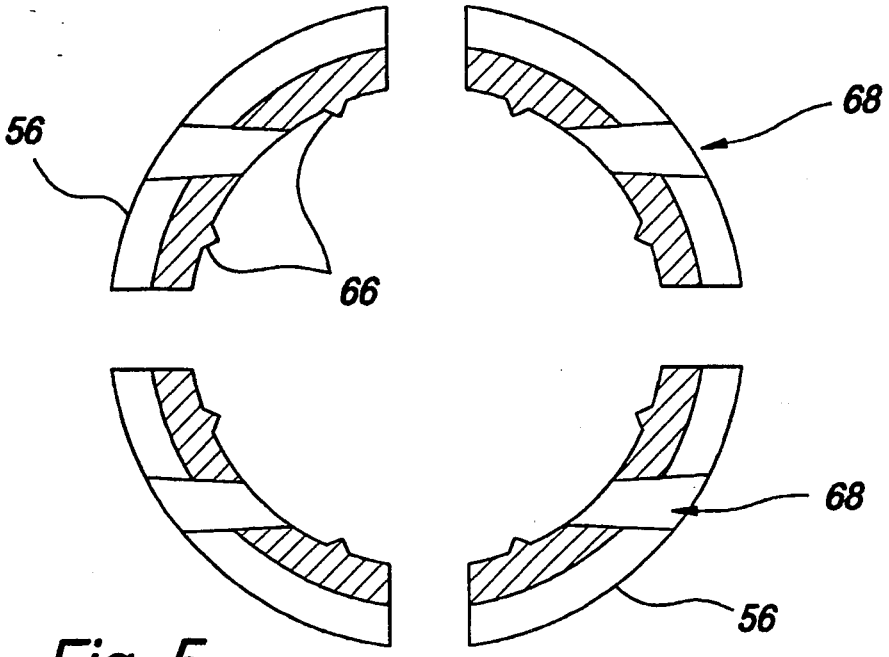
FIG. 5, is a plan view down a handle receiving end of a shaft according to the invention.
Figure 6:
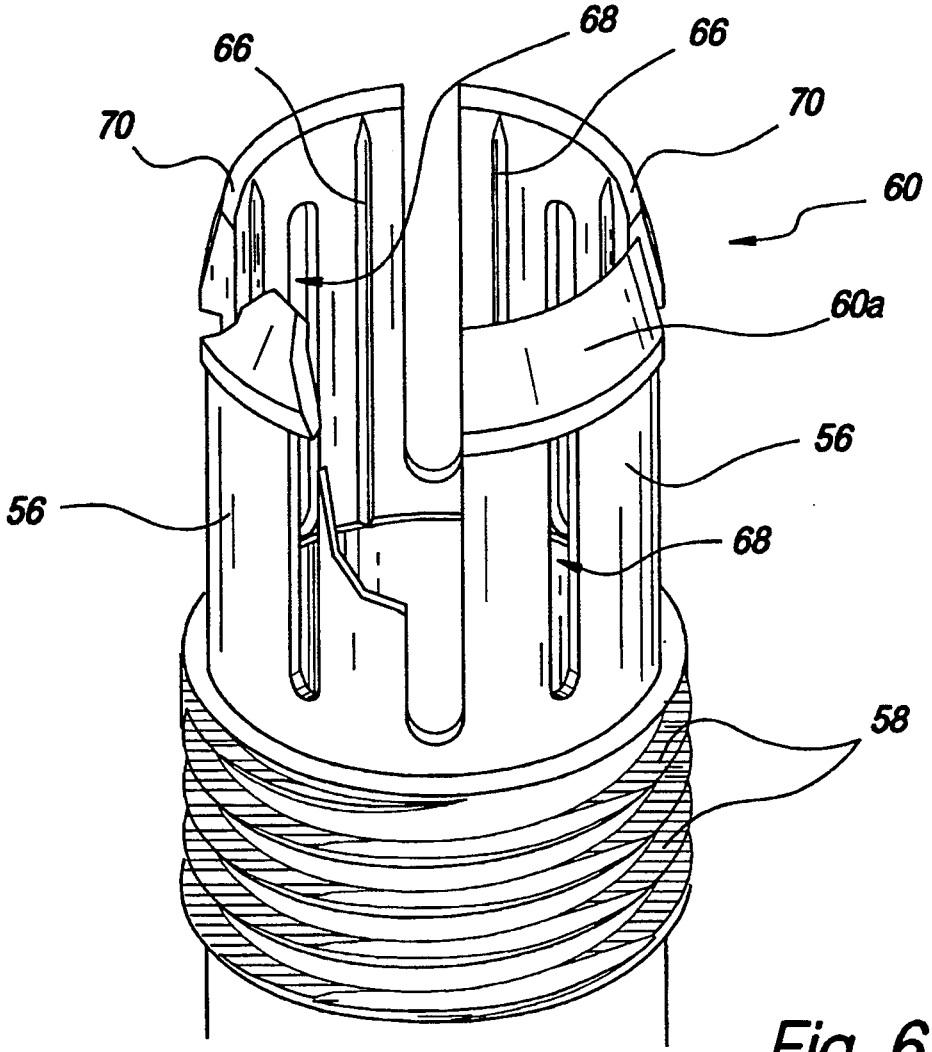
FIG. 6, is a perspective view of the handle receiveing end depicted in FIG. 5.

The mop frame holder may be secured to a threaded mop handle by providing the receptacle end with interior threads. Alternatively, the receptacle end may form a split collet for receiving threaded or unthreaded handles having varying diameters. The advantage of the split collet type receptacle end is that it locks a screwed in handle in position, keeping it from unscrewing due to the torques and twists of usage, to make a solid unit between the handle and mop frame holder. Such a collet, best seen in FIGS. 5 and 6, is typically a cylindrical handle receiving socket split longitudinally into sections 56 and having exterior threads 58 and a cone shaped handle receiving end 60. An outer sleeve 62, shown in FIG. 3, having interior threads 64 which cooperate with the exterior threads 58 on the cylindrical handle receiving socket moves longitudinally along the handle receiving socket. The outer sleeve 62 has an interior shaped to correspond and cooperate with the cone **60*a* at the handle receiving end 60 of the handle receiving socket. When the outer sleeve is screwed longitudinally on the handle receiving socket the interior of the sleeve slides down along the cone 60*a* of the handle receiving socket to force the sections 56** of the split collet inward against a handle disposed in the cylindrical socket.

Such a collet may have raised ribs 66 on the interior surface of the collet sections 56 to increase the bite against the handle, and longitudinal slots 68 in the collet sections to improve the ease with which the sections conform to the round handle. Preferably, the leading edge 70 of each collet section 56 is bevelled to form a bell mouth opening to increase the ease with which a handle may be insterted. While the nature of the handle receiving receptacle end is not critical, the collet type with a bell mouth opening is preferred since it advantageously makes insertion of a handle easier, especially when replacing an old handle when the split collet tends to close up to a smaller diameter. In any case, it is preferable that the wet mop holder be adaptable to varying handle types used in the janitorial industry.

It is advantageous to make the mop holder of the invention entirely out of molded plastic. Plastic is durable and does not rust. Moreover, plastic parts are quiet and tend to cause less damage when bumped into objects, such as wood furniture, painted furniture, tile floors and side boards, since there are no sharp edges. In a preferred embodiment, the plastic used is polypropylene which can optionally contain an ethylene copolymer to render it less brittle when cold and is most economical. Fillers known to those skilled in the art such as mica, talc and the like may be optionally added to the plastic. While this plastic is preferable for the reasons noted, it would be well within the skill in the art to select other appropriate plastics.

While the forgoing is a detailed description of the preferred embodiment of the invention, modifications and equivalents would be known to one of ordinary skill in the art. It is intended that this disclosure be construed to include such modifications and equivalents that are within the scope and spirit of this invention and the appended claims.

What is claimed is:

1. A mop holder comprising:

a) a shaft and a mop holding head, said shaft connected at an end to said mop holding head, said head including a rearward end surface and a rounded forward end with a mop securing groove disposed therein, said rounded forward end corresponding substantially to an arcuate portion of a circle that is convex with respect to said rearward end surface and having a width in the plane of said circle, and which forward end terminates proximal to said rearward end surface at two points at opposite ends of said arcuate portion such that the length of any straight perimetral side surface between said rearward end surface and the respective end points of said rounded forward end is substantially less than the width of said forward end so as to minimize the occurrence of straight perimetral side surfaces on said head;

b) a tightening member movably disposed on said shaft in a spaced relation to said head, said tightening member further comprising means for adjusting its position along said shaft;

c) a flexible strap connectable to said tightening member and adapted to traverse said forward end of said mop holding head, said strap having opposed ends and a middle portion therebetween, said ends being connectable with said tightening member such that said middle portion is receivable in said mop-securing groove, wherein said tightening member, when moved away from said head by said adjusting means, operates to tension said strap to grip a mop between said mop securing groove and said strap, said mop being tensioned against said forward end substantially along the entire arcuate portion of said forward end so as to substantially obscure said forward end.

2. A mop holder according to claim 1, wherein said shaft has exterior threads disposed thereon and said means for adjusting the tightening member comprises a nut disposed in a void in said tightening member, said nut engaging said exterior threads disposed on said shaft, whereby said tightening member can be adjusted toward and away from said head along said shaft by turning said nut.

3. A mop holder according to claim 2 which is made entirely out of molded plastic.

4. A mop holder according to claim 1, further comprising raised ribs disposed in said groove.

5. A mop holder according to claim 1, wherein said strap is fixedly attached at one end of said tightening member with a free end of said strap for releasably engaging a receiving portion of an opposite side of said tightening member.

6. A mop holder comprising:

a) a mop holding head having a substantially rounded forward end, said end having a groove disposed therein, and art end surface having a socket for receiving a shaft, said rounded forward end corresponding substantially to an arcuate portion of a circle that is convex with respect to said end surface and having a width in the plane of said circle, and which forward end terminates proximal to said end surface at two points at opposite ends of said arcuate portion so that the length of any perimetral side surface between said end surface and the respective end points of said rounded forward end is substantially shorter than the width of said forward end so as to minimize the occurrence of straight perimetral side surfaces on said head, and said circle having a radius of no more than about 2.5 inches such that said mop holding head is no more than about 5 inches wide in the plane of the head;

b) a shaft having exterior threads disposed thereon and a front end receivably engageable in said socket and a rear end for receiving a handle;

c) a tightening member comprising a center hole for slidably receiving said shaft and a void for receiving a threaded nut disposed normal to said hole, whereby said nut operates to move said tightening member in either direction along the exterior threads of said shaft;

d) a flexible strap secured to a side of said tightening member, said strap having a free end and adapted to traverse said forward end of said mop holding head, said strap having opposed ends and a middle portion therebetween, said ends being connectable with said tightening member such that said middle portion is receivable in said groove, wherein said tightening member, when moved away from said head by said nut, operates to tension said strap to grip a mop between said groove and said strap, said mop being tensioned against said forward end substantially along the entire arcuate portion of said forward end so as to substantially obscure the forward end of said mop holding head; and, wherein said flexible strap passes from said secured side, along the rounded forward end in said groove and terminates at art opposite side of said tightening member, and wherein the free end of said strap is received by a notch in said opposite side of the tightening member, whereby a mop placed across said rounded forward end is held securely between said strap and said groove when said tightening member is tightened by turning said nut thereby moving said tightening member away from said mop holding head.

7. A mop holder according to claim 6, which is made entirely out of molded plastic.

8. A mop holder according to claim 6, further comprising raised ribs disposed perpendicularly in said groove.

9. A mop holder according to claim 6, wherein said rear end for receiving, a handle is a split collet.

10. A mop holder according to claim 6, wherein the free end of said strap includes an enlarged portion for fitting within a notch on said tightening member for quick release of said strap.

11. A mop holder according to claim 10, wherein one end of said groove terminates at a slot having a hole portion through which said enlarged portion of said strap may pass, and the opposite end of said groove terminates at a slot having a notch for receiving a portion of said strap.

12. A mop holder comprising:

a) a threaded shaft;

b) a mop holding head engaging an end of said shaft, said head including a rearward end surface and a mop-securing groove disposed along a substantially rounded forward end, said rounded forward end corresponding substantially to an arcuate portion of a circle that is convex with respect to said rearward end surface and having a width in the plane of said circle, and which forward end terminates proximal to said rearward end surface at two points at opposite ends of said arcuate portion so that the length of any perimetral side surface between said rearward end surface and the respective end points of said rounded forward end is substantially shorter than the width of said forward end so as to minimize the occurrence of straight perimetral side surfaces on said head, and said circle having a radius of no more than about 2.5 inches such that said mop holding head is no more than about 5 inches wide in a plane of the head;

c) an adjustable tightening member slidably fitted onto said shaft for longitudinal movement thereon;

d) a threaded nut for threadably engaging said threaded shaft, said adjustable member engaging said nut to move longitudinally therewith along said shaft;

e) a flexible strap having opposed ends and a middle portion therebetween, said ends being connectable with said adjustable member such that said middle portion is receivable in said mop-securing groove, wherein said adjustable member, when moved away from said head by said nut, operates to tension said strap to grip a mop between said mop securing groove and said strap, wherein said mop is held substantially along the entire arcuate portion of said forward end so as to substantially obscure the forward end of said mop holding head.

13. A mop holder comprising:

a) a shaft and a mop holding head, said shaft connected at an end to said mop holding head, said head including a rearward end surface and a rounded forward end with a mop securing groove disposed therein, said rounded forward end corresponding substantially to an arcuate portion of a circle that is convex with respect to said rearward end and having a width in the plane of said circle, and which intersects said rearward end surface at two points at opposite ends of said arcuate portion so as to eliminate substantially all straight perimetral side surfaces between said rearward end surface and the respective end points of said rounded forward end on said head;

b) a tightening member movably disposed on said shaft in a spaced relation to said head, said tightening member further comprising means for adjusting its position along said shaft;

c) a flexible strap connectable to said tightening member and adapted to traverse said forward end of said mop holding head, said strap having opposed ends and a middle portion therebetween, said ends being connectable with said tightening member such that said middle portion is receivable in said mop-securing groove, wherein said tightening member, when moved away from said head by said adjusting means, operates to tension said strap to grip a mop between said mop securing groove and said strap, said mop being tensioned against said forward end substantially along the entire arcuate portion of said forward end so as to substantially obscure said forward end, whereby a mop disposed at the forward end of said head is held securely by said flexible strap when said tightening member is moved away from said head along said shaft by said adjusting means.

14. A mop holder according to claim 1 or 13 wherein said rounded forward end corresponds to an arcuate portion of a circle having a radius of no more than about 2.5 inches such that said mop holding head is no more than about 5 inches wide in the plane of the head.

* * * * *